United States Patent [19]

Asari et al.

[11] Patent Number: 4,777,814

[45] Date of Patent: Oct. 18, 1988

[54] METHOD AND APPARATUS FOR EJECTING JAMMED BILLETS FROM METAL EXTRUSION PRESS

[75] Inventor: Akira Asari, Osaka, Japan
Masuda, Kobe, both of Japan

[73] Assignee: Kabushiki Kaisha Kobe Seiko Sho, Kobe, Japan

[21] Appl. No.: 285,287

[22] Filed: Jul. 20, 1981

[30] Foreign Application Priority Data

Jul. 25, 1980 [JP] Japan ..... 55-102849

[51] Int. Cl.[4] ..... B21C 35/00

[52] U.S. Cl. ..... 72/273.5; 72/253.1; 72/273

[58] Field of Search ..... 72/253.1, 257, 263, 72/265, 273, 273.5, 270, 254, 255

[56] References Cited

U.S. PATENT DOCUMENTS

| | | | |
|---|---|---|---|
| 3,736,786 | 6/1973 | Wagner | 72/255 |
| 4,103,529 | 8/1978 | Huertgen et al. | 72/273.5 |
| 4,342,212 | 8/1982 | Sibler | 72/273.5 |

FOREIGN PATENT DOCUMENTS

| | | | |
|---|---|---|---|
| 570750 | 2/1933 | Fed. Rep. of Germany | 72/270 |
| 5114859 | 7/1974 | Japan | 72/273.5 |
| 57-28618 | 2/1982 | Japan | 72/273.5 |
| 55102849 | 11/1984 | Japan . | |
| 316259 | 9/1930 | United Kingdom | 72/273.5 |
| 1235182 | 6/1971 | United Kingdom | 72/254 |

*Primary Examiner*—Lowell A. Larson
*Attorney, Agent, or Firm*—Oblon, Fisher, Spivak, McClelland & Maier

[57] ABSTRACT

Method and apparatus for removing a jammed billet from a container on a metal extrusion press in which a billet in a container is extruded through a die at the fore end of a die stem by relative movement of the die stem admitted into the container while the billet and container are held stationary relative to each other. Should the billet in the container jam, pressure is applied on the rear end face of the billet in the axial pressing direction thereby extruding the billet in the counter-pressing axial direction.

3 Claims, 9 Drawing Sheets

METHOD AND APPARATUS FOR EJECTING JAMMED BILLETS FROM METAL EXTRUSION PRESS

BACKGROUND OF THE INVENTION

1. Field of the Invention

This invention relates to metal extrusion presses, and more particularly to a method and apparatus for ejecting jammed billets from indirect metal extrusion presses.

2. Description of the Prior Art

As is well known in the art, indirect extrusion presses which hold a container and a billet stationary relative to each other during the extruding operation have a number of inherent advantages over the direct extrusion presses, including: higher quality of the final product due to improved billet flow; no friction between a billet and a container; no heat generation by billets; higher extrusion speed; smaller power requirement for the press.

Therefore, indirect extrusion presses permit use of billets of longer dimensions. However, longer billets sometimes tend to stick in the container and become difficult to extrude due to temperature decrease of the hot billets or for other reasons, necessitating the removal of jammed billet from the container at the press center.

In one of the conventional mechanisms which have thus far been resorted to for removing jammed billets from the container, only short billets are used on the press so that they can be easily pushed out of the containers by ordinary operating power of the press in the event they jam in the container. This method, however, sacrifices one of the above-mentioned inherent advantages of the indirect extrusion press and is inefficient as compared with the operations with longer billets.

In another conventional method, the container is provided with a heater for raising the temperature of a jammed billet by rapid heating, thereby facilitating the removal of the billet. This method, however, has the drawback that large equipment costs are incurred, coupled with the complication of the construction and inconveniences in handling.

In an even worse case, a container containing repairs of a jammed billet has to be dismantled from the press machine to be scraped off manually, in spite of the heavy and time-consuming job of dismantling and reassembling the container.

SUMMARY OF THE INVENTION

With the foregoing in view, the present invention has as its object the provision of a method and apparatus for removing jammed billets in a simple and secure manner by the use of minimum necessary power.

According to one aspect of the present invention, there is provided a method for removing jammed billets from a container on an indirect metal extrusion press in which a billet in a container is extruded through a die at the fore end of a die stem by relative movement of the die stem admitted into the container while the billet and container are held stationary relative to each other. The method including the steps of applying on a rear end face of a jammed billet in the container a pressure acting in the axial pressing direction, thereby causing the jammed billet to be extruded in a counter-pressing direction.

According to another aspect of the present invention, there is provided an apparatus for removing jammed billets from an indirect metal extrusion press of the sort mentioned above. The apparatus includes either a combination of a hollow cylindrical pressurizing stem for applying extruding force to the billet and an annular dummy block having a die hole larger in diameter than the die of the die stem and detachably mounted at the fore end of the pressuring stem through a closure block or an ejecting stem for applying extruding force to the billet and having a number of longitudinal circumferential grooves extending over a predetermined length from the fore end thereof.

The above and other objects, features and advantages of the invention will become apparent from the following description and the appended claims taken in conjunction with the accompanying drawings which show by way of example some preferred embodiments of the invention.

DETAILED DESCRIPTION OF THE PREFERRED EMBODIMENTS

Figure 1:
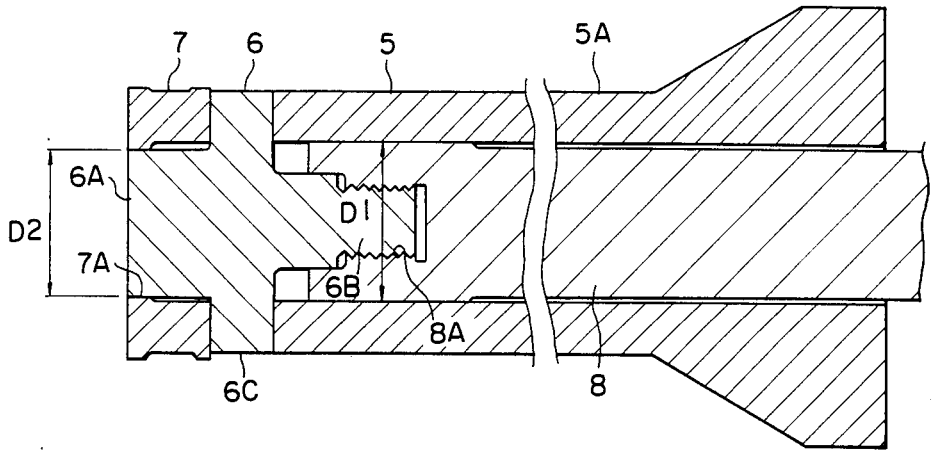
FIG. 1 is a longitudinal section of a pressurizing stem of a double action type indirect extrusion press incorporating the present invention.

FIGS. 1 through 9 illustrate the invention as applied to a double-action extrusion press, including a container 1 which is provided with a billet-receiving bore 1A at the press center and which is movable reciprocally in the axial direction of the press through a piston-cylinder (not shown). Designated by reference number 2 is a cylindrical die stem at the fore end of which a die 3 is fixedly mounted in a die ring 4, die 3 having an opening which defines the outer shape of the product to be extruded. Die stem 2 is held stationary at least during the extruding operation in alignment with the axis of a press platen (not shown). In this connection, the arrangements may be such that die stem 2 is fixably reciprocable into and out of the press platen through a gate lock to the press platen or fixably slidable laterally between a position at the press center and a piston outside the press machine.

Indicated by reference number 5 is a pressurizing stem located at the press center substantially opposingly to die stem 2 and imparted with an extruding power from a press power generating unit (not shown) through a crosshead or similar member. Pressurizing stem 5 is also permitted idle forward movement through a side piston-cylinder (not shown).

Pressurizing stem 5 is provided with a cylindrical portion 5A having an internal bore substantially of diameter D1 and has an annular dummy block 7 mounted at its fore end through a closure block 6. More specifically, annular dummy block 7 is centrally provided with a die hole 7A of diameter D2 to receive a solid plug portion 6A of closure 6. Therefore, die hole 7A is substantially closed by the plug portion 6A of closure 6 which has its end face disposed substantially flush with the pressing surface of annular dummy block 7. A screw portion 6B which is provided axially on the rear side of closure 6 is threaded into a female screw portion 8A at the fore end of a holder 8 which is fitted in cylindrical portion 5A of pressurizing stem 5.

More particularly, holder 8 fitted in the cylindrical portion 5A is independently extendible by operation of a piston-cylinder (not shown), and has screw portion 6B of closure 6 detachably threaded into female screw portion 8A. Flange portion 6C of closure 6, which is of the same outer diameter as pressurizing stem 5, is abutted against the end face of pressurizing stem 5, with plug portion 6A being disengageably fitted in annular dummy block 7. The diameter D2 of die hole 7A in annular dummy block 7 is greater than the diameter of the die stem 5 but smaller than diameter D1 of pressurizing stem 5.

Figure 6:
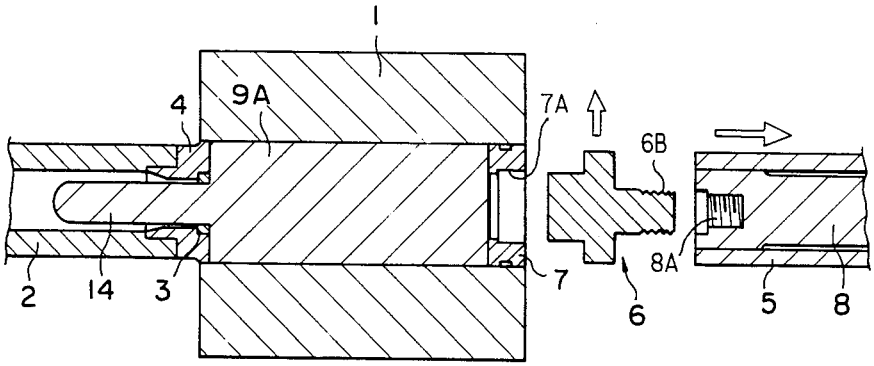
Figure 7:
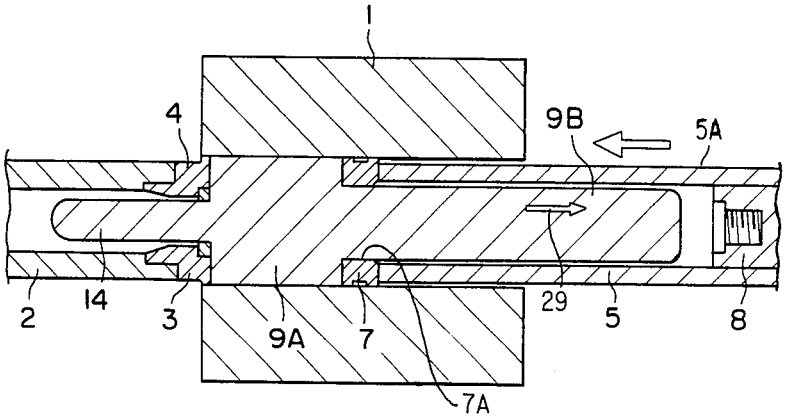
Figure 8:
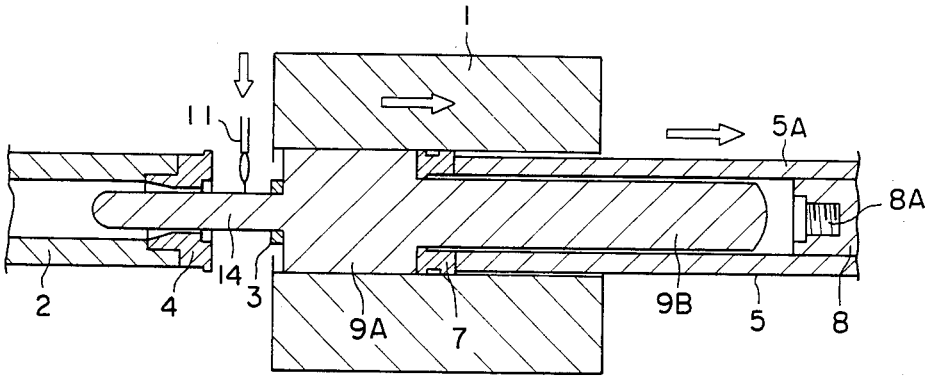
Figure 9:
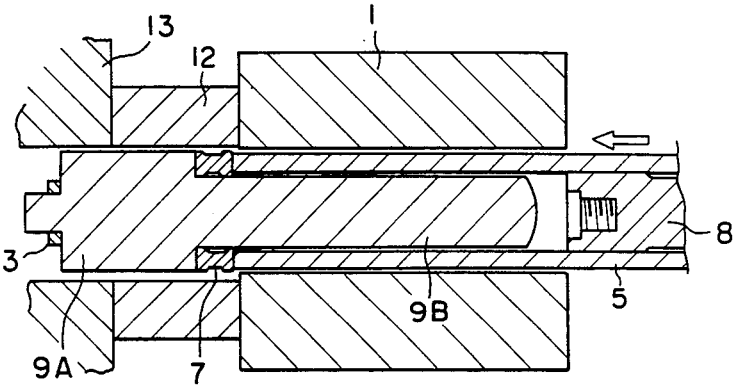
Figure 10:
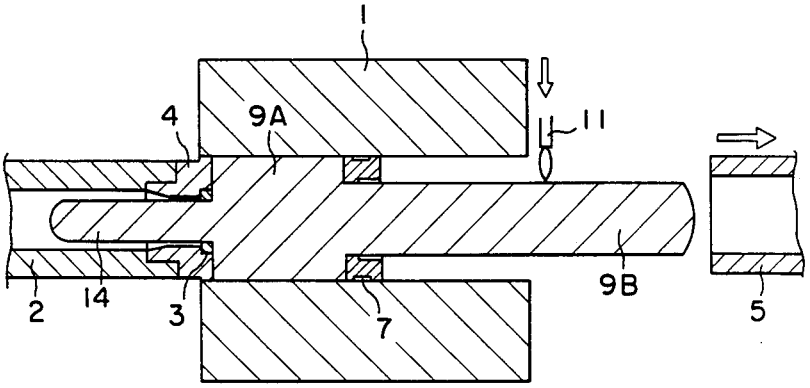
FIGS. 10 to 12 are longitudinal sections illustrating a modified billet-removing operation.

In FIGS. 2 through 9, indicated by reference number 9 is a billet and by reference number 10 a billet loader. Loader 10 is movable between the press center and a position outside the press machine, supporting thereon billet 9 and annular dummy block 7. In FIGS. 8 and 10, reference numeral 11 denotes a cutting tool for severing the extruded material. Although the cutting tool is shown as a gas-cutting torch which is mounted on the container or other structure movably toward and away from the press center in the particular embodiment shown, it may be substituted with a rotary saw or a reciprocating cutter if desired. Further, in FIG. 9, designated by reference number 12 is an ejecting ring which is fixably movable toward and away from the press center alternately with die stem 2.

Figure 2:
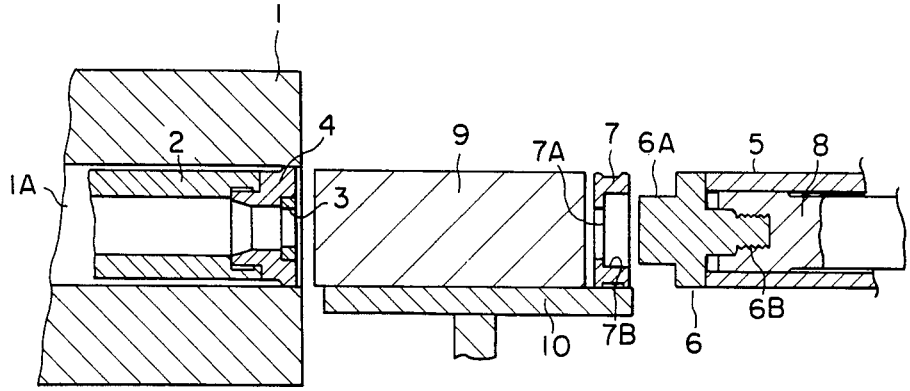
FIG. 2 to 4 are views similar to FIG. 1, illustrating billet charging, billet upsetting, and extruding operations by the press, respectively.
Figure 3:
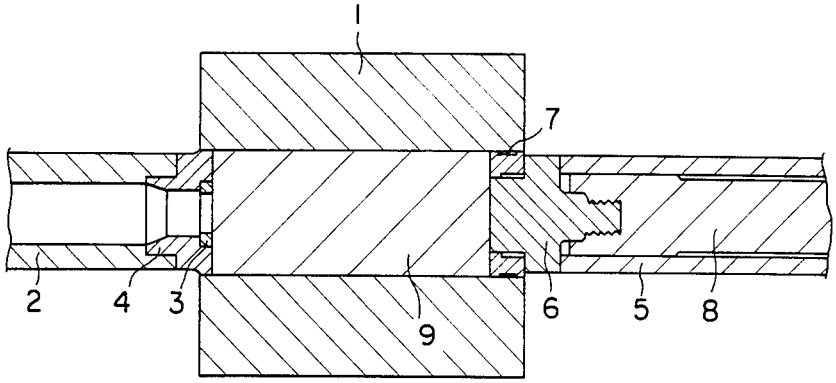
Figure 4:
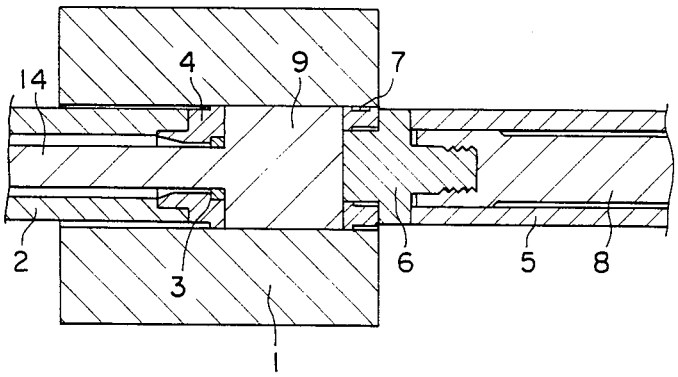

The extruding and billet ejecting operations in the above-described indirect extrusion press are as follows. Referring to FIGS. 2 to 4, which illustrate different phases of the extruding operation, a billet 9 is initially charged into container 1 which surrounds die stem 2 as shown in FIG. 2, by advancing die loader 10 carrying the billet 9 and annular dummy block 7 toward the press center in a space between die stem 2 and pressurizing stem 5, followed by free forward movement of pressurizing stem 5. Plug portion 6A of the closure 6 is thus fitted in hole 7B of annular dummy block 7, and billet 9 is gripped between pressurizing stem 5 and die ring 4. Then, loader 10 is retracted to a position outside the machine, and container 1 is moved to the right in FIG. 2 (inverse to the pressing direction) to charge billet 9 and dummy block 7 in its billet receiving bore 1A.

Next, a forward force is imparted to pressurizing stem 5 by the pressing power generator, whereupon billet 9 is upset as shown in FIG. 3 and held stationary relative to container 1, while die stem 2 is caused to enter container 1 by relative movement. Consequently, billet 9 is extruded through die 3 at the fore end of die stem 2, forming a solid extrudate 14 as shown in FIG. 4.

Figure 5:
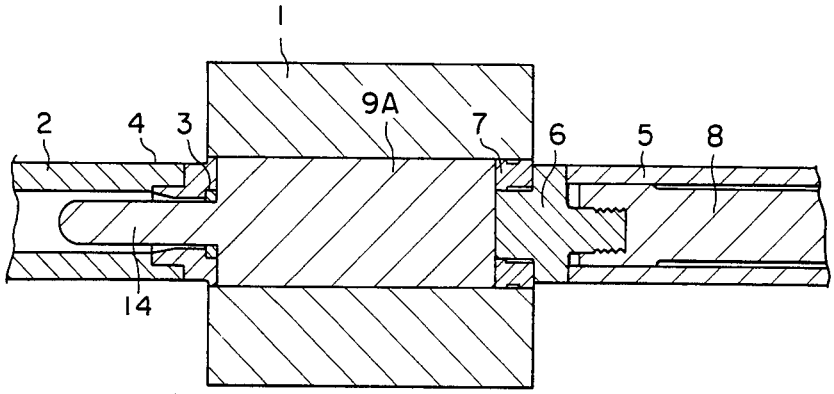
FIGS. 5 to 9 are longitudinal sections illustrating different phases of an operation for removing a jammed billet from the press.

Now, when billet 9 in container 1 sticks and becomes difficult to extrude due to a temperature decrease or for other reasons as illustrated in FIG. 5, pressurizing stem 5 is retracted and closure 6 is freed from annular dummy block 7, which remains in container 1 as shown in FIG. 6. Then, connecting screw portion 6B of closure 6 is loosened and disengaged from the female screw portion 8A to remove closure 6 from the machine, also as shown in FIG. 6.

Thereafter, holder 8 is retracted. Extruding press power is then generated and applied to pressurizing stem 5, advancing pressurizing stem 5 and abutting the fore end face against the rear end face of annular dummy block 7 to impose the press power thereon. The extruding press power causes the thereon, whereupon jammed billet 9A to move axially through die hole 7A in a direction inverse to the pressing direction as indicated by arrow 29 in FIG. 7, so as to enter cylindrical portion 5A of pressurizing stem 5. The extrusion of the jammed billet 9A through the die hole 7A gradually reduces occurring the frictional force between container 1 and jammed billet 9A.

Since die hole 7A in annular dummy block 7 is larger than the opening in the die 3 of die stem 2, the jammed billet 9A can be extruded in the counter-pressing axial direction by the normal power of the extruding power generator even though billet 9A fails to extrude in the forward direction due to its increased resistance against container 1. Billet 9A can be extruded without interfering with cylindrical portion 5A of pressurizing stem 5 insofar as it is larger than die hole 7A in annular dummy block 7.

Thus, after extruding a necessary length of the jammed billet 9A in the counter-pressing direction, container 1 and pressurizing stem 5 are retracted to cut off extrudate 14 by cutter 11 as illustrated in FIG. 8. After retracting die stem 2 and mounting an ejecting ring 12, the extruding power is applied to pressurizing stem 5 to push jammed billet 9A out of container 1 as shown in FIG. 9.

Figure 11:
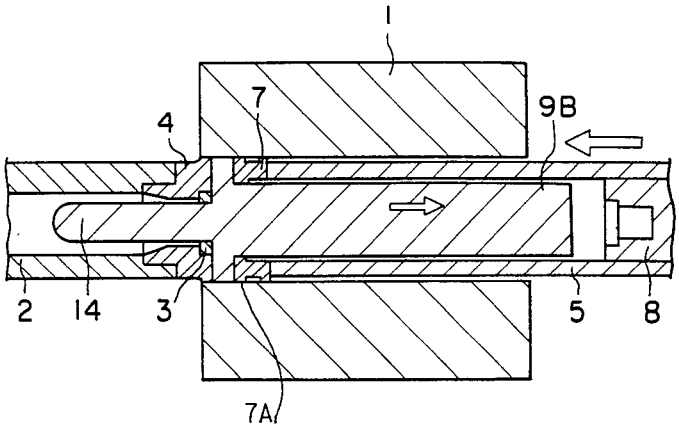
Figure 12:
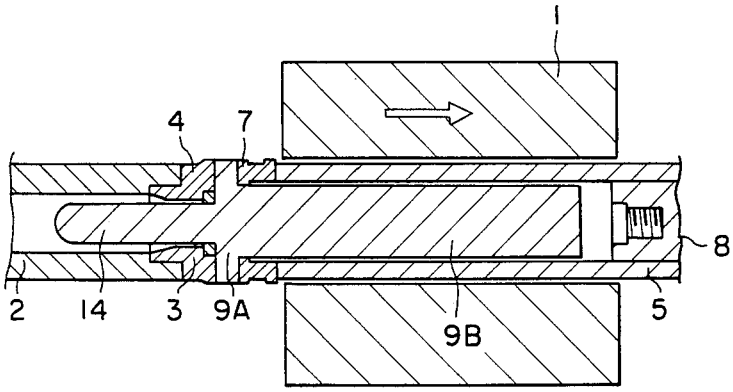

FIGS. 10 to 12 illustrate a modified billet handling operation which differs from the foregoing operation in the steps occurring after FIG. 7. More specifically, after extruding a jammed billet 9A in the counter-pressing direction by pressurizing stem 5 as in FIG. 7, pressurizing stem 5 is retracted and extruded billet 9B is cut off by cutting tool 11 behind container 1 as illustrated in FIG. 10. The pressurizing stem 5 is moved forward again to extrude the jammed billet 9A almost entirely through die hole 7A of annular dummy block 7 as shown in FIGURE 11, extracting billet 9A from the container 1 by retracting the latter as shown in FIG. 12. In the operation of FIGURES 10 to 12, pressurizing stem 5 is retracted and billet 9A is removed from die 3 of die stem 2 together with dummy block 7 and carried away from the machine in the steps subsequent to FIG. 12.

Figure 13:
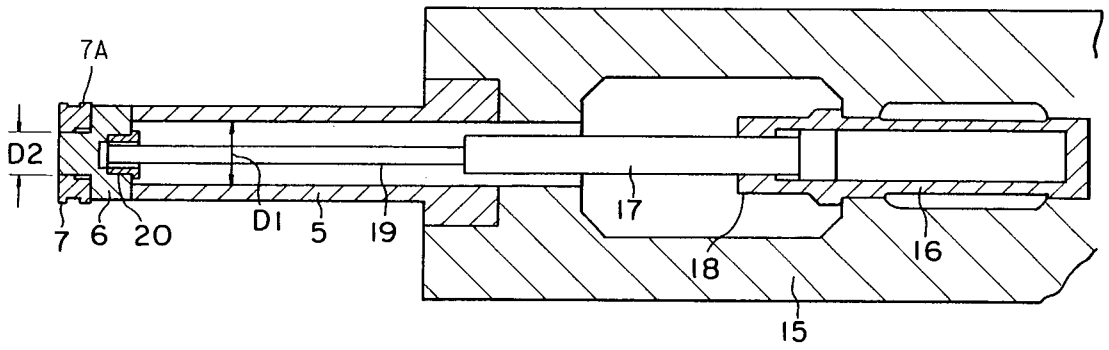
FIG. 13 is a longitudinal section of a pressurizing stem of a single-action type indirect extrusion press.

FIG. 13 shows another embodiment of the invention, applied to the so-called single-action indirect extrusion press, in which an extendible cylinder device including a hydraulic cylinder 16 and a piston 17 is provided at the press center of a crosshead 15. Dummy block 7 is mounted through closure block 6. Closure block 6 in turn is detachably mounted at the fore end of pressurizing stem 5 by way of a cylindrical connector 20 at the fore end of a bolt 19 which is connected to piston 17.

In the embodiment of FIG. 13, if billet 9A in the container 1 is found to be jammed, closure 6 is removed and the extruding power is imparted to pressurizing stem 5 with cylinder device 18 in the contracted state, applying the extruding force on the rear end face of jammed billet 9A through annular dummy block 7 to extrude billet 9A in the counter-passing axial direction through die hole 7A in dummy block 7.

Figure 14:
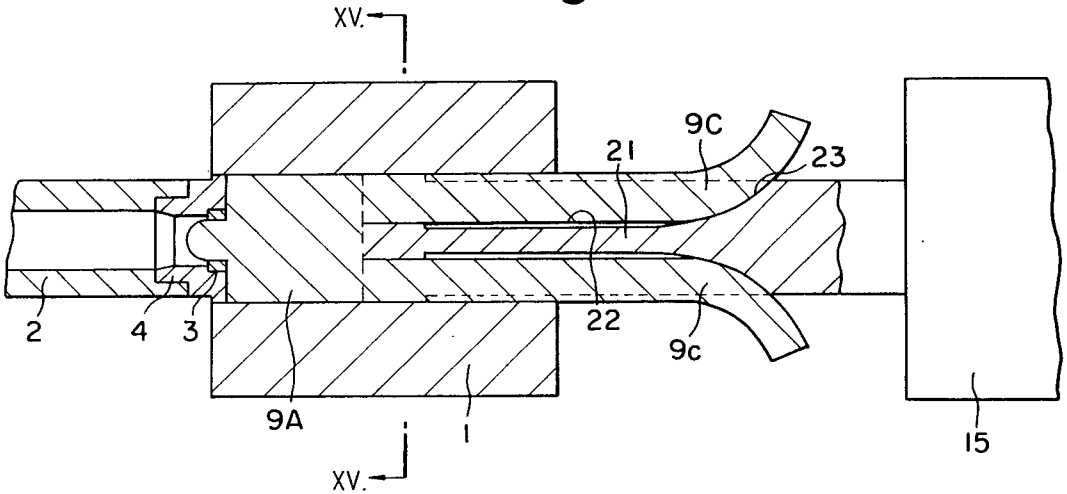
FIG. 14 is a longitudinal section illustrating a billet-removing operation according to another embodiment of the invention.
Figure 15:
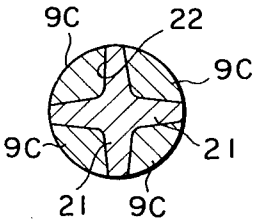
FIG. 15 is a sectional view taken on line XV—XV of FIG. 14.

FIGS. 14 and 15 illustrate another useful embodiment of the present invention, which employs an ejecting stem 21 in the crosshead 15 in place of the above-mentioned pressurizing stem 5. The ejecting stem has the so-called stellate shape in cross-section as shown in FIG. 14, with longitudinal grooves 22 the roots of which diverge radially outwardly in the base portion of the stem as indicated by reference number 23.

In the event of extrusion failure in the embodiment of FIGS. 14 and 15, pressurizing stem 5 (which may be of a solid structure in this case) is retracted into its rearmost position, and instead ejecting stem 21 is mounted in position. Upon imparting the extruding power to ejecting stem 21 by the extruding power generator, the fore end of stem 21 is pressed against the rear end face of jammed billet 9A. Billet 9A is thus extruded in the counter-pressing axial direction, the billet portions squeezed into longitudinal grooves 22 of the stem 21 being guided therealong the spread apart at diverging base portion 23 as indicated at 9C.

The embodiment of FIG. 14 in which jammed billet 9A is split onto the circumference of ejecting stem 21 has an additional advantage in that the condition of the split billet portions can be observed for inspection, control or other purposes.

Figure 16:
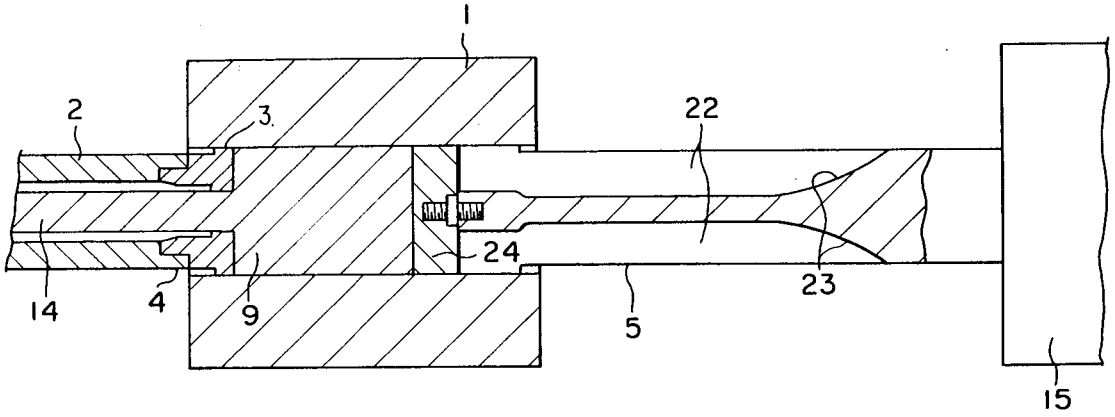
FIG. 16 is a longitudinal section illustrating a counter-pressed billet in a modification of the method of FIG. 14.

FIG. 16 illustrates a modification of the embodiment of FIG. 14 in which pressurizing stem 5 itself is provided in the form of ejecting stem 21, with an ordinary solid dummy block 24 detachably mounted at the fore end of pressurizing stem 5. As shown in FIG. 16, billet 9 is extruded through die 3 in cooperation with dummy block 24. Should a jamming phenomenon occur during the extruding operation, pressurizing stem 5 is initially retracted. After removing dummy block 24, the pressurizing stem 5 is advanced again, whereupon jammed billet 9 is extruded in the counter-pressing axial direction along circumferential grooves 22 in the same manner as in FIG. 14.

As is clear from the foregoing description, the present invention makes it possible to remove jammed billets in a simple and easy manner even when the billets are of long dimension, without materially sacrificing the time period of the press cycle, by the use of minimum necessary power for the ejection of the jammed billets coupled with simplicity of construction of the apparatus.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for removing a jammed billet from a container in an indirect metal extrusion press comprising the container, a pressurizing stem which acts on one face of the billet, and a die stem containing a die which acts on the opposite face of the billet, in which a billet is normally extruded from the container through the die by forcing the die stem and the pressurizing stem towards one another, thereby forcing the die stem into the container and forcing the billet out through the die, said method comprising the steps of:

(a) providing an axial opening in the face of the pressurizing stem which abuts the billet, which axial opening has a greater cross-sectional area than the opening in the die, and (b) forcing the die stem and the pressurizing stem towards one another, thereby forcing the pressurizing stem into the container and forcing the billet out through the axial opening in the pressurizing stem.

2. A method for removing a jammed billet from a container in an indirect metal extrusion press comprising the container, a pressurizing stem which acts on one face of the billet, and a die stem containing a die which acts on the opposing face of the billet, in which a billet is normally extruded from the container through the die by forcing the die stem and the pressurizing stem towards one another, thereby forcing the die stem into the container and forcing the billet out through the die, said method comprising the steps of:

(a) providing an axial opening in the face of the pressurizing stem which is adjacent the billet, which axial opening has a greater cross-sectional area than the opening in the die, and (b) forcing the die stem and the pressurizing stem towards one another, thereby forcing the pressurizing stem into the container and forcing the billet out through the axial opening in the pressurizing stem.

3. An indirect metal extrusion press comprising apparatus for handling a jammed billet, said indirect metal extrusion press comprising:

(a) a container for billets;

(b) a pressurizing stem positioned to act on one face of a billet in said container, said pressurizing stem having an axial opening in its working face;

(c) a die stem containing a die positioned to act on the opposite face of a billet in said container;

(d) first means for forcing said pressurizing stem and said die stem towards each other, thereby normally forcing said die stem into said container and forcing the billet out through said die;

(e) an annular dummy block having an axial throughhole formed therein which has greater cross sectional area than the opening in said die, said annular dummy block being positioned between the billet and said pressurizing stem; and (f) a closure block which is detachably mounted on the working face of said pressurizing stem, said closure block comprising a plug portion which is sized and shaped to be received in and to fill the axial throughhole in said annular dummy block, whereby, when a billet becomes jammed in said container, said closure block is detached from said pressurizing stem, the axial throughhole in said annular dummy block communicates with the axial opening in said pressurizing stem, and the billet is forced out through the axial throughhole in said annular dummy block and into the axial opening in said pressurizing stem.

* * * * *

UNITED STATES PATENT AND TRADEMARK OFFICE

CERTIFICATE OF CORRECTION

PATENT NO. : 4,777,814

DATED : October 18, 1988

INVENTOR(S) : Akira Asari

It is certified that error appears in the above-identified patent and that said Letters Patent is hereby corrected as shown below:

On the title page, Item [75] delete "Masuda, Kobe, both of Japan".

Signed and Sealed this

Twenty-eighth Day of February, 1989

*Attest:*

DONALD J. QUIGG

*Attesting Officer*

*Commissioner of Patents and Trademarks*